US009322297B2

(12) United States Patent
Brunhuber et al.

(10) Patent No.: US 9,322,297 B2
(45) Date of Patent: Apr. 26, 2016

(54) ENERGY STORAGE INSTALLATION WITH OPEN CHARGING CIRCUIT FOR STORING SEASONALLY OCCURRING EXCESS ELECTRICAL ENERGY

(71) Applicant: Siemens Aktiengesellschaft, Munich (DE)

(72) Inventors: Christian Brunhuber, Auerbach (DE); Carsten Graeber, Erlangen (DE); Gerhard Zimmermann, Hochstadt/Aisch (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 214 days.

(21) Appl. No.: 14/364,380

(22) PCT Filed: Nov. 13, 2012

(86) PCT No.: PCT/EP2012/072450

§ 371 (c)(1),
(2) Date: Jun. 11, 2014

(87) PCT Pub. No.: WO2013/087321

PCT Pub. Date: Jun. 20, 2013

(65) Prior Publication Data

US 2014/0338330 A1 Nov. 20, 2014

(30) Foreign Application Priority Data

Dec. 13, 2011 (DE) ..... 10 2011 088 380

(51) Int. Cl.
*F01K 23/04* (2006.01)
*F01K 1/00* (2006.01)

(Continued)

(52) U.S. Cl.
CPC . *F01K 3/00* (2013.01); *F01K 13/00* (2013.01); *F01K 23/02* (2013.01); *F28D 17/00* (2013.01)

(58) Field of Classification Search
CPC ..... F01K 3/00; F01K 23/02; F01K 13/00; F28D 17/00
USPC ..... 60/650, 655, 659, 682–684
See application file for complete search history.

(56) References Cited

U.S. PATENT DOCUMENTS 4,100,745 A * 7/1978 Gyarmathy ..... F02C 6/14 60/652
4,347,706 A * 9/1982 Drost ..... F01K 3/00 290/52

(Continued)

FOREIGN PATENT DOCUMENTS

CN 1447016 A 10/2003
CN 101970833 A 2/2011

(Continued)

*Primary Examiner* — Hoang Nguyen
(74) *Attorney, Agent, or Firm* — Beusse Wolter Sanks & Maire

(57) ABSTRACT

An energy storage device for storing thermal energy, with a charging circuit for a working gas, is provided, having a compressor, heat accumulator and expansion turbine, the compressor and expansion turbine arranged on a common shaft, and the compressor connected on the outlet side to the inlet of the expansion turbine via a first line for the working gas, the heat accumulator wired into the first line, wherein the compressor is connected on the inlet side to a line, which is open to the atmosphere, and the expansion turbine is connected on the outlet side to a line, which is open to the atmosphere such that a circuit open to the ambient air is formed, wherein the expansion turbine is connected to the heat accumulator via a line for a hot gas such that the working gas in the expansion turbine can be heated by heat from the heat accumulator.

9 Claims, 2 Drawing Sheets

(51) Int. Cl.

| | |
|---|---|
| ***F01K 3/00*** | (2006.01) |
| ***F01K 13/00*** | (2006.01) |
| ***F01K 23/02*** | (2006.01) |
| ***F28D 17/00*** | (2006.01) |

(56) References Cited

U.S. PATENT DOCUMENTS

| | | | | | |
|---|---|---|---|---|---|
| 4,479,353 | A | * | 10/1984 | Schluderberg | F01K 3/00 165/145 |
| 4,765,142 | A | | 8/1988 | Nakhamkin | |
| 5,269,145 | A | * | 12/1993 | Krause | C09K 5/063 126/618 |
| 5,436,508 | A | | 7/1995 | Sorensen | |
| 2009/0121495 | A1 | * | 5/2009 | Mills | F01K 3/00 290/4 D |
| 2010/0251712 | A1 | | 10/2010 | Nakhamkin | |
| 2010/0257862 | A1 | | 10/2010 | MacNaghten | |
| 2011/0100010 | A1 | | 5/2011 | Belloni | |
| 2011/0127004 | A1 | | 6/2011 | Belloni | |
| 2012/0167559 | A1 | | 7/2012 | Havel | |

FOREIGN PATENT DOCUMENTS

| | | | |
|---|---|---|---|
| DE | 99415 | A2 | 8/1973 |
| DE | 2615439 | A1 | 9/1977 |
| DE | 102006008600 | A1 | 8/2007 |
| DE | 102009036167 | A1 | 2/2011 |
| DE | 102010014833 | A1 | 10/2011 |
| JP | 2003193865 | A | 7/2003 |
| WO | 2010081883 | A2 | 7/2010 |

* cited by examiner

ENERGY STORAGE INSTALLATION WITH OPEN CHARGING CIRCUIT FOR STORING SEASONALLY OCCURRING EXCESS ELECTRICAL ENERGY

CROSS REFERENCE TO RELATED APPLICATIONS

This application is the US National Stage of International Application No. PCT/EP2012/072450 filed Nov. 13, 2012, and claims the benefit thereof. The International Application claims the benefit of German Application No. DE 102011088380.0 filed Dec. 13, 2011. All of the applications are incorporated by reference herein in their entirety.

FIELD OF INVENTION

The need for storing energy arises in particular from the progressively growing proportion of power plants operating in the renewable energies sector. Here, the aim of the energy storage is to make it possible to make the power plants with renewable energies usable in power transmission networks such that energy generated using renewables can also be made use of in a time-offset manner, in order thereby to save on fossil fuels and thus reduce $CO_2$ emissions. The present invention relates to an energy storage installation with open charging circuit for storing seasonally occurring excess electrical energy.

BACKGROUND OF INVENTION

US 2010/0257862 A1 describes a principle of a known energy storage installation, in which use is made of a piston-type machine. From U.S. Pat. No. 5,436,508, it is furthermore known that, by means of energy storage installations for storing thermal energy, it is also possible to temporarily store overcapacities that arise during the use of wind energy for producing electrical current.

During the charging of the accumulator, such energy stores convert electrical energy into thermal energy and store the thermal energy. During the discharging process, the thermal energy is converted back into electrical energy.

Owing to the time period that has to be bridged by an energy store, that is to say the time over which energy is stored into and released from the energy store, and owing to the power that must be stored, correspondingly high demands are placed on the dimensions of thermal energy stores. Thermal energy stores can thus be very expensive in terms of purchase costs simply owing to the structural size. If the energy store is furthermore of complex design, or the actual energy storage medium is expensive in terms of production costs or cumbersome in terms of operation, the purchase and operating costs for a thermal energy store can quickly call into question the economic viability of the energy storage.

Owing to the often low thermal conductivity of the expensive storage materials, the heat exchanger surfaces must often be designed to be very large. The large number and the length of heat exchanger pipes can in this case lead to a significant rise in costs of the heat exchanger, which costs can no longer be compensated by an inexpensive storage material.

Until now, in order to replace large heat exchangers, heat exchangers have been designed on the basis of relatively inexpensive materials, primarily in the form of heat exchangers for a direct exchange of heat between the heat carrier, for example air, and the storage material, such as for example sand or gravel. The fluidized bed technique known in principle in the art has not hitherto been implemented on a scale that would be required for seasonal storage of excess renewable energy. A direct exchange of heat furthermore entails relatively complicated handling of the solid matter, which is not economical for a large store.

As heat carrier medium, use is made of a working gas, for example air. The working gas may in this case be conducted optionally in a closed or an open charging circuit or auxiliary circuit.

An open circuit always uses ambient air as working gas. Said ambient air is drawn in from the surroundings and is discharged into the environment again at the end of the process, such that the environment closes the open circuit. A closed circuit also permits the use of a working gas other than ambient air. Said working gas is conducted in the closed circuit. Since an expansion into the environment, with the ambient pressure and the ambient temperature simultaneously being adopted, is omitted, the working gas must, in the case of a closed circuit, be conducted through a heat exchanger which allows the heat of the working gas to be released to the environment. Since, in a closed circuit, use may also be made of dehumidified air or other working gases, it is possible to dispense with a multi-stage configuration of the compressor and a water separator. A disadvantage here is however the additional cost outlay for the purchase and operation of an additional heat exchanger downstream of the expansion turbine, or upstream of the compressor, for heating the working gas to working temperature for the compressor. During operation, this reduces the efficiency of the energy storage installation.

It may alternatively be provided that the charging circuit for the storage of the thermal energy in the heat accumulator is in the form of an open circuit, and that the compressor is constructed with two stages, wherein a water separator for the working gas is provided between the stages. Here, allowance is made for the fact that air moisture is contained in the ambient air. An expansion of the working gas in a single stage can have the effect that, owing to the intense cooling of the working gas to, for example, −100° C., the air moisture condenses and hereby damages the expansion turbine. In particular, icing can cause permanent damage to turbine blades. An expansion of the working gas in two steps however makes it possible for condensed water to be separated off, in a water separator downstream of the first stage, at for example 5° C., such that, during a further cooling of the working gas in the second turbine stage, said working gas has already been dehumidified, and formation of ice can be prevented or at least reduced. Disadvantages here, too, are however the increased cost outlay for the purchase of a multi-stage compressor and of a water separator. Also, during operation, the efficiency of a plant of said type is reduced.

SUMMARY OF INVENTION

It is an object of the invention to specify an inexpensive energy storage installation for storing thermal energy on the basis of inexpensive storage materials, which energy storage installation exhibits improved efficiency. Here, it is sought in particular to avoid the disadvantages from the prior art. A further object of the invention is to specify a method by means of which thermal energy can be stored in inexpensive storage materials with improved efficiency.

The installation-related object of the invention is achieved by means of the features of the claims.

According to aspects of the invention, an energy storage installation for storing thermal energy comprises a charging circuit for a working gas, said charging circuit comprising a compressor, a heat accumulator and an expansion turbine, wherein the compressor and the expansion turbine are arranged on a common shaft, and wherein the compressor is connected at the outlet side to the inlet of the expansion turbine via a first line for the working gas, and the heat accumulator is incorporated into the first line, and the compressor is connected at the inlet side to a line which is open to the atmosphere, and the expansion turbine is connected at the outlet side to a line which is open to the atmosphere, such that a circuit is formed which is open to the ambient air. According to aspects of the invention, the expansion turbine is connected via a line for a hot gas to the heat accumulator, such that the working gas in the expansion turbine can be heated by heat from the heat accumulator. Said line, which is in particular not identical to the first line, ensures that a partial stream of the hot air downstream of the heat accumulator is conducted to the expansion turbine.

An aspect of the invention is that a partial stream of the hot air downstream of the heat accumulator is conducted to the expansion turbine in order, as is the case in gas turbines, to be conducted into the turbine blades in order to prevent icing problems at the cold end of the expansion turbine.

Owing to the recuperation of the compressor waste heat in the charging circuit and the release of cold expansion air to the environment, a heat pump efficiency of considerably greater than 100% is achieved. The recuperation of the compressor waste heat is made possible by virtue of the fact that only high-temperature heat, for example >320° C., is used in the thermal accumulator. Heat at a lower temperature level is used to preheat the ambient air at the compressor inlet, whereby the electrical energy demand for the quasi-adiabatic compression is reduced, and high heat pump efficiency is made possible. The heat exchange during the recuperation may take place either directly in an air-air heat exchanger or by means of an intermediate circuit with an efficient heat carrier medium (for example thermal oil).

In the simplest case, the circuit is composed, as in the case of a Joule process, of a compression and an expansion. The exact number of compressor and expander stages with intermediate cooling of the air may however be freely selected and must be optimized from a techno-economic aspect. The air charging circuit serves for the generation of high-temperature heat, which permits efficient reconversion into electricity, though may alternatively also be used directly, for example for generating heat for district heating. In the thermal or heat accumulator, owing to the higher efficiency potential, a direct heat exchange with the hot compressed air (in the case of charging) and with the water/vapor (in the case of discharging) with the storage material is preferable (direct admission).

The expansion turbine, by being arranged on the same shaft as the compressor, furthermore reduces the energy outlay for the compression process and contributes significantly to assisting the compressor.

Since the cooling of the working gas at low temperatures requires very large heat exchanger surfaces, it is also possible, owing to the fact that the utilization of the relatively low temperatures is dispensed with, for the heat accumulator to be realized at lower cost, because the heat exchanger can be of smaller dimensions.

Overall, by means of the measure according to the invention, a considerable increase in energy storage efficiency is achieved. Furthermore, the energy storage installation according to the invention is significantly less expensive in terms of purchase costs than a conventional energy storage installation in which the working gas is cooled substantially entirely in the heat exchanger.

In one advantageous further development of the invention, a heat exchanger is provided which, at the primary side, is incorporated into the first line for the working gas downstream of the heat accumulator and which, at the secondary side, is incorporated into the line leading to the compressor, such that heat from the working gas can be transferred to the drawn-in ambient air in the line leading to the compressor.

In a further advantageous refinement of the invention, a first auxiliary heater is provided which is incorporated into the first line for the working gas, upstream of the expansion turbine, such that the working gas can be heated before it enters the expansion turbine. The auxiliary heating may be performed electrically. By means of the auxiliary heater, a further increase in efficiency can be realized by virtue of the maximum storage temperature upstream of the heat accumulator being raised. Alternatively or in addition, it is possible, in a further refinement, for a second auxiliary heater to be provided which is incorporated into the first line upstream of the heater accumulator, such that the working gas can be heated before it enters the heat accumulator. Regulability and availability can be further increased by means of the second auxiliary heater.

The release of the stored energy may be realized for example by means of a steam circuit.

The thermal energy may be seasonally occurring excess energy from a power plant that uses renewable energies. Porous materials, sand, gravel, rock, concrete, water or salt solution are particularly suitable as storage material for the heat accumulator of the heat exchanger process.

DETAILED DESCRIPTION OF INVENTION

Figure 1:
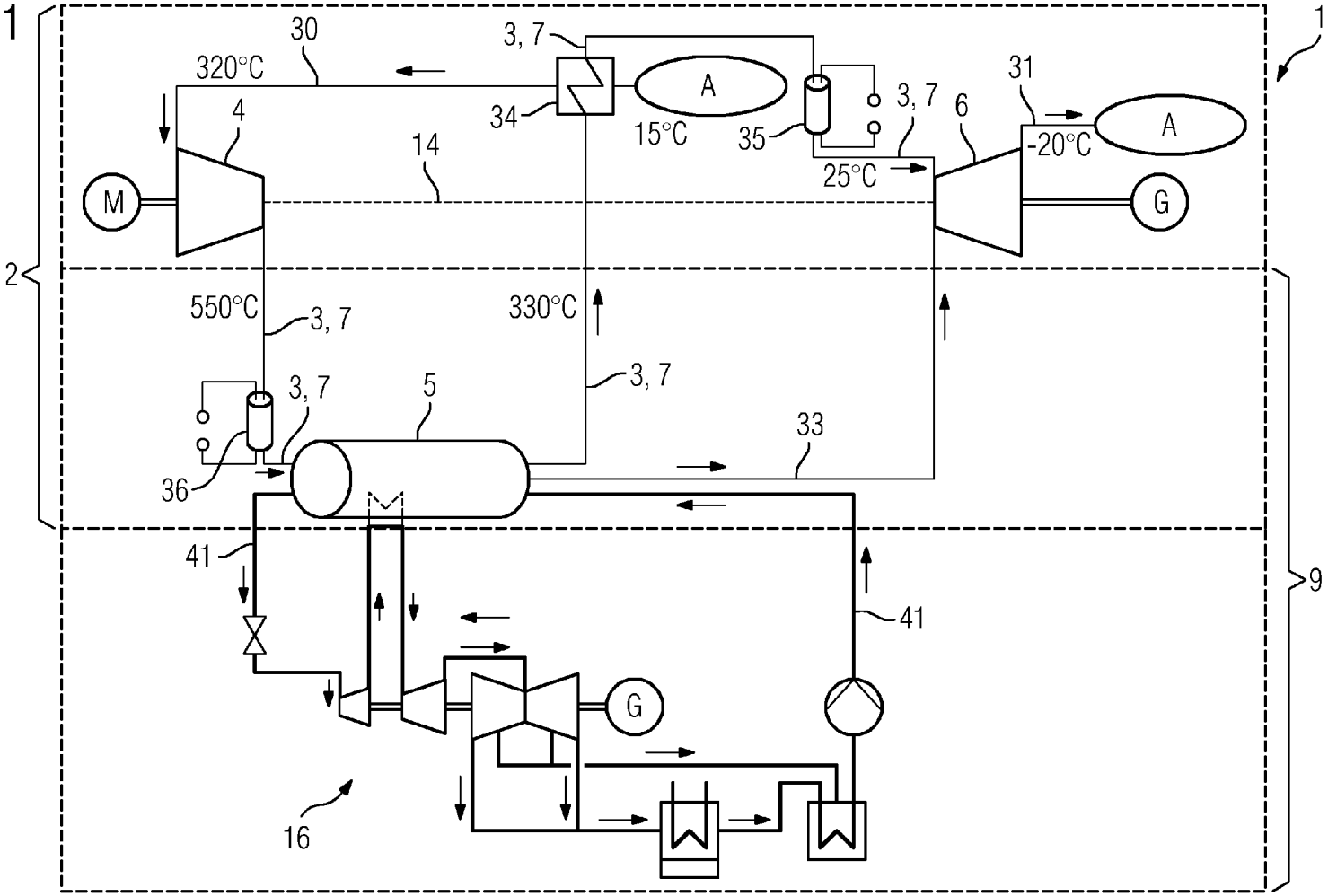
FIGS. 1-2 show examples of an energy storage installation for storing thermal energy according to aspects of the invention.
Figure 2:
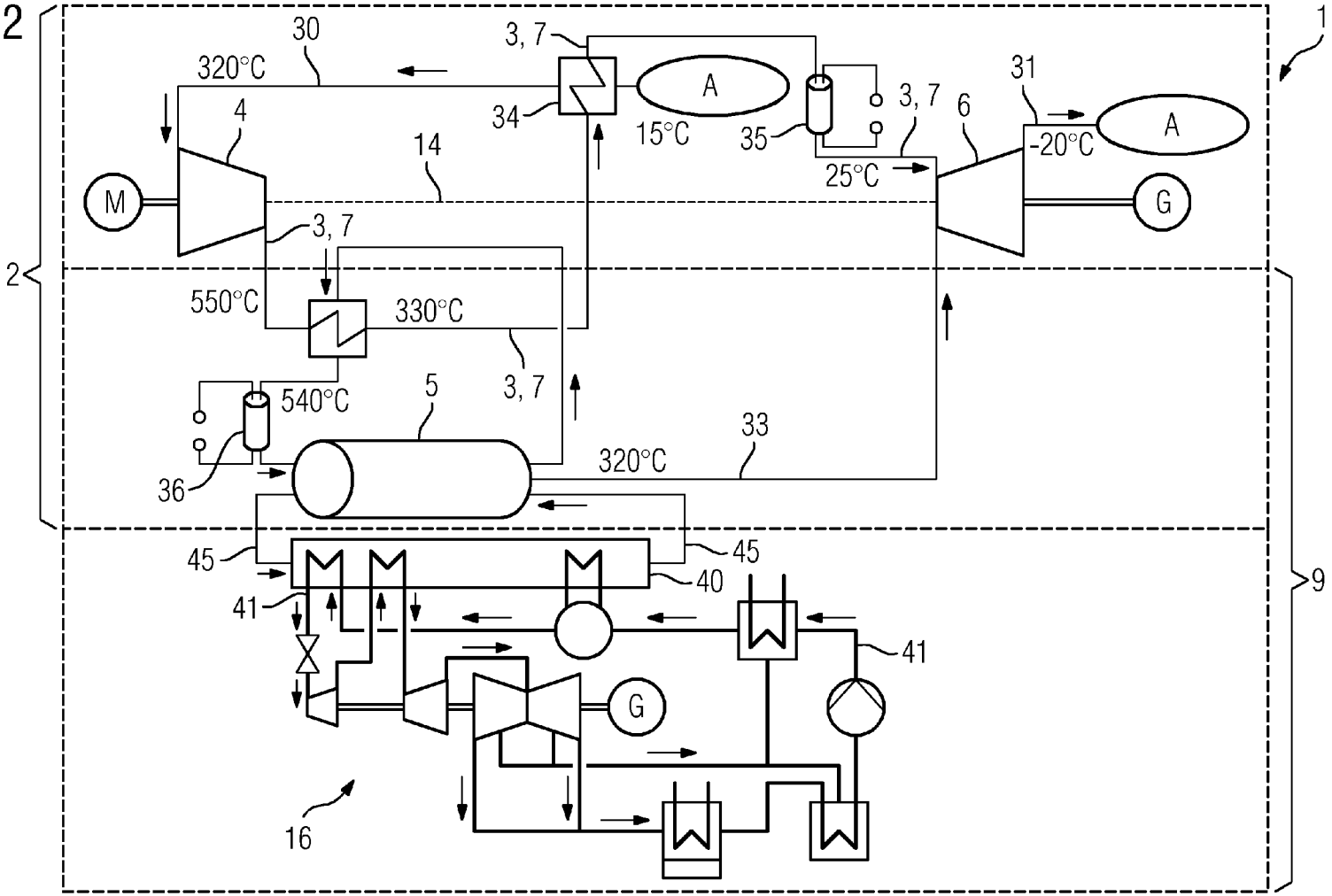

As shown in FIGS. 1-2, an energy storage installation 1 for storing thermal energy, having a charging circuit 2 for a working gas 3 is provided. The charging circuit has a compressor 4, a heat accumulator 5 and an expansion turbine 6. The compressor 4 and the expansion turbine 6 are arranged on a common shaft 14. The compressor 4 is connected at the outlet side to the inlet of the expansion turbine 6 via a first line 7 for the working gas 3, and the heat accumulator 5 is incorporated into the first line 7, and the compressor 4 is connected at the inlet side to a line 30 which is open to the atmosphere A, and the expansion turbine 6 is connected at the outlet side to a line 31 which is open to the atmosphere A, such that a circuit is formed which is open to the ambient air. The expansion turbine 6 is connected via a line 33 for a hot gas to the heat accumulator 5, such that the working gas 3 in the expansion turbine 6 can be heated by heat from the heat accumulator 5.

In embodiments of the energy storage installation 1, the line 33, which is in particular not identical to the first line 7, ensures that a partial stream of the hot air downstream of the heat accumulator is conducted to the expansion turbine.

In embodiments of the energy storage installation 1, a heat exchanger 34 is provided which, at the primary side, is incorporated into the first line 7 downstream of the heat accumulator 5 and which, at the secondary side, is incorporated into the line 30, such that heat from the working gas 3 in the first line 7 can be transferred to the drawn-in ambient air in the line 30.

According to further embodiments of the energy storage installation 1, a first auxiliary heater 35 is provided which is incorporated into the first line 7 upstream of the expansion turbine 6, such that the working gas 3 can be heated before it enters the expansion turbine 6.

According to further embodiments of the energy storage installation 1, a second auxiliary heater 36 is provided which is incorporated into the first line 7 upstream of the heat accumulator 5, such that the working gas 3 can be heated before it enters the heat accumulator 5.

According to further embodiments of the energy storage installation 1, a discharging circuit 9 is provided into which the heat accumulator 5 and furthermore a steam turbine plant 16 with a water-steam circuit 41 are connected, wherein steam for expansion in the steam turbine plant 16 can be generated by the heat exchanger.

The heat exchanger 5 may be incorporated into the water-steam circuit 41 of the steam turbine plant 16, such that the steam can be generated directly in the heat exchanger 5.

According to further embodiments of the energy storage installation 1, a heat recovery steam generator 40 is provided which, at the primary side, is connected via a circuit 45 for hot air to the heat accumulator 5, and which, at the secondary side, is connected to the water-steam circuit 41 of the steam turbine plant 16.

The storage material of the heat accumulator 5 may be porous material, sand, gravel, stone, concrete, water or salt solution. The energy storage installation may be used for storing seasonal excess electrical energy in a power plant that is operated with renewable energies.

The invention claimed is:

1. An energy storage installation for storing thermal energy, comprising:

a charging circuit for a working gas, said charging circuit comprising a compressor, a heat accumulator and an expansion turbine, wherein the compressor and the expansion turbine are arranged on a common shaft, and wherein the compressor is connected at the outlet side to the inlet of the expansion turbine via a first line for the working gas, and the heat accumulator is incorporated into the first line, and the compressor is connected at the inlet side to a second line which is open to the atmosphere, and the expansion turbine is connected at the outlet side to a third line which is open to the atmosphere, such that a circuit is formed which is open to the ambient air, wherein the expansion turbine is connected via a fourth line for a hot gas to the heat accumulator, such that the working gas of the expansion turbine can be heated by heat from the heat accumulator, and a discharging circuit into which the heat accumulator and furthermore a steam turbine plant with a water-steam circuit are connected, wherein steam for expansion in the steam turbine plant can be generated by means of a heat exchanger.

2. The energy storage installation as claimed in claim 1, wherein the fourth line, which is not identical to the first line, ensures that a partial stream of the hot air downstream of the heat accumulator is conducted to the expansion turbine.

3. The energy storage installation as claimed in claim 1, further comprising a heat exchanger which, at the primary side, is incorporated into the first line downstream of the heat accumulator and which, at the secondary side, is incorporated into the second line, such that heat from the working gas in the first line can be transferred to the drawn-in ambient air in the second line.

4. The energy storage installation as claimed in claim 1, further comprising a first auxiliary heater which is incorporated into the first line upstream of the expansion turbine, such that the working gas can be heated before it enters the expansion turbine.

5. The energy storage installation as claimed in claim 1, further comprising a second auxiliary heater which is incorporated into the first line upstream of the heat accumulator, such that the working gas can be heated before it enters the heat accumulator.

6. The energy storage installation as claimed in claim 5, wherein the heat exchanger is incorporated into the water-steam circuit of the steam turbine plant, such that the steam can be generated directly in the heat exchanger.

7. The energy storage installation as claimed in claim 1, further comprising a heat recovery steam generator which, at the primary side, is connected via a circuit for hot air to the heat accumulator, and which, at the secondary side, is connected to the water-steam circuit of the steam turbine plant.

8. The energy storage installation as claimed in claim 1, wherein the storage material of the heat accumulator is porous material, sand, gravel, stone, concrete, water or salt solution.

9. The energy storage installation as claimed in claim 1, wherein the energy storage installation is used for storing seasonal excess electrical energy in a power plant that is operated with renewable energies.

* * * * *